US006207934B1

(12) United States Patent
Steiner et al.

(10) Patent No.: US 6,207,934 B1
(45) Date of Patent: Mar. 27, 2001

(54) COOK TOP WITH INSTALLATION FRAME FORMED BY BENDING

(75) Inventors: Herbert Steiner, Traunstein; Georg Brandl, Palling; Markus Theine, Freilassing; Johann Huber, Inzell, all of (DE)

(73) Assignee: BSH Bosch und Siemens Haushaltsgeraete GmbH, Munich (DE)

( * ) Notice: Subject to any disclaimer, the term of this patent is extended or adjusted under 35 U.S.C. 154(b) by 0 days.

(21) Appl. No.: 09/449,719

(22) Filed: Nov. 24, 1999

(30) Foreign Application Priority Data

Nov. 24, 1998 (DE) ..... 198 54 228

(51) Int. Cl.[7] ..... H05B 3/68
(52) U.S. Cl. ..... 219/452.11
(58) Field of Search ..... 219/451.1, 452.11, 219/452.12, 454.12, 456.1; 126/211, 214, 214 C, 39 B; 99/378, 422; 29/610.1, 611

(56) References Cited

U.S. PATENT DOCUMENTS 3,870,862 * 3/1975 Doner ..... 219/452.12
4,363,956 * 12/1982 Scheidler et al. ..... 219/452.12
4,453,533 * 6/1984 Scheidler et al. ..... 219/452.12
5,317,129 * 5/1994 Taplan et al. ..... 219/452.12
5,571,434 * 11/1996 Cavener et al. ..... 219/452.12

* cited by examiner

*Primary Examiner*—Sang Paik
(74) *Attorney, Agent, or Firm*—Herbert L. Lerner; Laurence A. Greenberg; Werner H. Stemer

(57) ABSTRACT

A cook top with a cook top panel, in particular a cook top panel made of glass ceramic, which is secured on a metallic, single-piece installation frame. The frame has side walls that extend essentially perpendicularly to the cook top panel and which has, on a base side, an installation shoulder which extends parallel to the cook top panel, at a spacing from the cook top panel. The installation shoulder surrounds a large-surface-area base opening formed in the installation frame. The installation shoulder is provided with component openings for securing components of the cook top. In order for it to be possible to configure the installation frame in the simplest possible manner in production terms, the installation frame is configured as a bent part. In this case, at least four side walls are configured as individual side-wall sections which are separate from one another and are each bent individually at right angles from the installation shoulder around a periphery.

9 Claims, 2 Drawing Sheets

COOK TOP WITH INSTALLATION FRAME FORMED BY BENDING

BACKGROUND OF THE INVENTION

Field of the Invention

The present invention relates to a cook top with a cook top panel, in particular a cook top panel made of a glass ceramic, which is secured on a metallic, single-part installation frame. The side walls of the frame extend essentially perpendicularly to the cook top panel and the frame further has, on a base side, an installation shoulder which extends parallel to the cook top panel, at a spacing from the cook top panel. The installation shoulder surrounds a large-surface-area base opening of the installation frame and in which there are provided installation openings for securing components of the cook top. The invention further relates to a corresponding production process.

Such a cook top is known from Published, Non-Prosecuted German Patent Application DE 295 13 246.9 A, and has a decorative frame which can be connected to the installation frame consisting, for example, of deep-drawn chromium-nickel steel. The installation frame, which serves as the basic part for assembly, is likewise produced by deep drawing and serves, inter alia, for fastening functional components of the cook top, for example residual-heat displays, retaining elements for heating elements and the like.

SUMMARY OF THE INVENTION

It is accordingly an object of the invention to provide a cook top with an installation frame formed by bending that overcome the above-mentioned disadvantages of the prior art devices and methods of this general type, in which the installation frame of the cooking cook top has a simplified construction.

With the foregoing and other objects in view there is provided, in accordance with the invention, a cook top, including:

a cook top panel; and a metallic, single-piece installation frame receiving and securing the cook top panel, the metallic, single-piece installation frame having side walls extending substantially perpendicularly to the cook top panel and a base side, the base side having an installation shoulder extending parallel to the cook top panel, at a spacing from the cook top panel, the installation shoulder having component openings formed therein for securing other components, the base side has a large-surface-area base opening formed therein and delimited by the installation shoulder, the side walls are individual side-walls sections separate from one another and each being bent individually at right angles from the installation shoulder around a periphery.

This is achieved according to the invention, in the case of a cook top of the generic type, in that the installation frame is produced by bending. In this case, the side walls are configured as individual side-wall sections which are separate from one another and are each bent individually at right angles from the installation shoulder around the periphery. The process according to the invention is characterized in that the four side walls of the installation frame are each bent at right angles, as individual surfaces, out of a base panel of the frame and the base panel also forms the installation shoulder. The side walls are fixed to one another in respect to adjacent border regions. Installation openings are punched into the installation shoulder in order to secure components of the cook top, and a large-surface-area cutout is also punched out of the base panel. The critical advantage over the solution of the prior art is that, by bending, the size and the contours of the installation shoulder can easily be configured in a variable manner in production terms. This results in a higher level of variation in the size and position of the installation openings that can be disposed in the installation shoulder and/or components of the cook top. As a result of which a wide range of cook tops can be realized particularly easily and cost-effectively in production terms along with sufficient stability and a high degree of accuracy.

In order to stabilize and/or stiffen the installation frame, a decorative frame may be connected to the latter. Advantageously provided for this purpose in the side walls of the installation frame are installation openings for securing the decorative frame.

Particularly precise positioning is achieved in production if in each case two side walls of the installation frame are connected to one another by press joining or clinching in the bending tool in the corner region of the frame, at bent connecting lugs. Alternatively, the fixed connection may also be realized by welding.

In order to further increase the stability of the configuration, specific profile regions realized by bending are provided in the side walls of the installation frame.

It is also possible for the stability of the cook top to be increased further in that the cook top panel is adhesively bonded to the bent installation frame and/or the decorative frame via an adhesive connection. Therefore, the frame parts and the panel of the cook top can be fixed in a permanent manner once the lugs have been adjusted to the optimum installation position. Moreover, a corresponding adhesive bead may additionally protect the cook top against the penetration of liquid.

Other features which are considered as characteristic for the invention are set forth in the appended claims.

Although the invention is illustrated and described herein as embodied in a cook top with an installation frame formed by bending, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
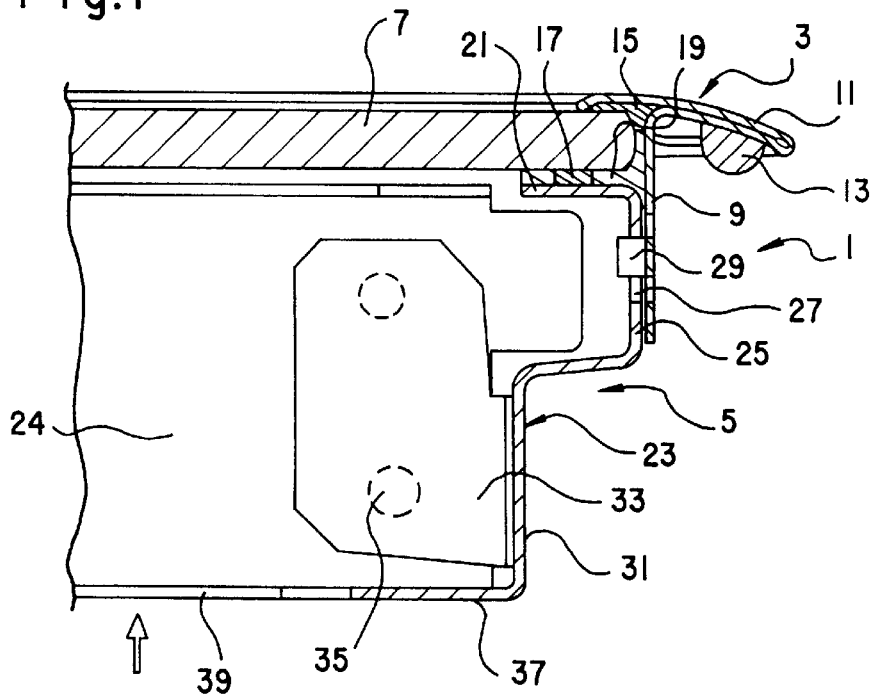
FIG. 1 is a diagrammatic, fragmented, sectional view taken along the line I—I shown in FIG. 3, of a part of a cook top according to the invention.
Figure 3:
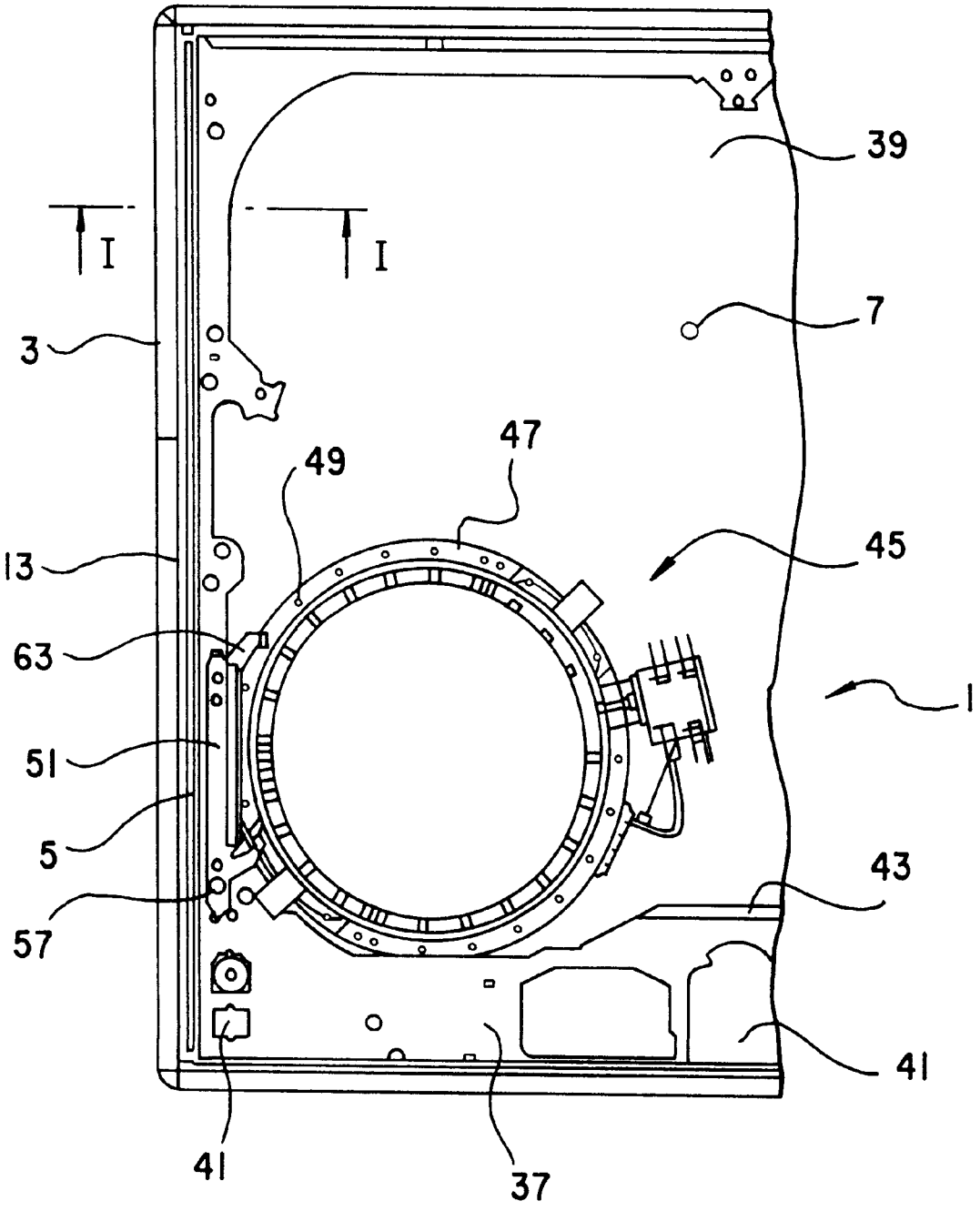
FIG. 3 is a fragmented plan view from beneath of a cook top panel (directional arrow in FIG. 1), of the part of the cook top with a heating element installed.

In all the figures of the drawing, sub-features and integral parts that correspond to one another bear the same reference symbol in each case. Referring now to the figures of the drawing in detail and first, particularly, to FIG. 1 thereof, there is shown a cook top or hob 1 with a rectangular decorative frame 3 which is made of high-grade steel and is connected to a single-piece, rectangular installation frame 5 which is disposed there-beneath and is made of sheet steel. A glass-ceramic panel 7, known per se, of the cook top 1 is secured between the decorative frame 3 and the installation frame 5. On a top side of the glass-ceramic panel 7, the latter has suitable decorative prints which mark the heatable hot plates of the cook top 1 (not shown). The decorative frame 3 is configured in a number of parts and essentially in the form of a T in profile. A curved decorative-frame cover panel 11 is formed by bending part of a decorative-frame side wall 9 which extends perpendicularly to the glass-ceramic panel 7 around the periphery of the latter. A first sealing bead 13 is provided (FIGS. 1 and 3) on an underside of a leg-like outer section of the decorative-frame panel 11, the outer section projecting in an outward direction away from the glass-ceramic panel 7. By the sealing bead 13, the cook top 1 or the decorative frame 3 rests with suitable sealing, for example, on a correspondingly cut-out work top in a manner known per se (not shown). Furthermore, a second, foamed sealing bead 15 is provided around the periphery in the interspace between a top side of the glass-ceramic panel 7 and an underside of the inwardly projecting leg-like inner section of the decorative-frame panel 11. The glass-ceramic panel 7 is thus surrounded by the decorative frame 3 and has the latter engaging over it around the periphery by the decorative-frame cover panel 11. A plurality of small elastic adhesive-tape portions 17 is adhesively bonded around the periphery of the border region of the glass-ceramic panel 7, on the underside of the latter. At the same time, in this region, a silicone-adhesive bead 19 is provided around the periphery of the glass-ceramic panel 7 and between a border region of the glass-ceramic panel 7 and the inside of the decorative-frame side wall 9. In addition to fixing the two frame parts 3, 5 and the cook top panel 7, the adhesive connection 19 also serves for sealing the cook top 1 in this region. The glass-ceramic panel 7 is supported, via the adhesive-tape portions 17, around the periphery on a supporting shoulder 21 which belongs to the installation frame 5 and extends in the form of a frame parallel to the glass-ceramic panel 7. The supporting shoulders 21 are each bent individually at right angles from the four side walls 23, 24 of the rectangular installation frame 5. Rectangular lug openings 27 are punched (FIG. 1) around the periphery in a top wall region 25 of the side walls 23, 24 of the installation frame 5. Rectangular installation lugs 29 which are cut out on three sides from the decorative-frame side wall 9 are bent into the lug openings 27 and positioned therein. In order to simplify the installation of the decorative frame 3 on the installation frame 5, a small gap is provided around the periphery between the decorative-frame side wall 9 and the installation-frame side wall 23. In a bottom wall region 31 of the side wall 23, a connecting lug 33 is bent from the side wall at right angles and perpendicularly to the glass-ceramic panel 7 and thus extends parallel to the adjacent side wall 24 of the installation frame 5. The two side walls 23, 24 are fixed to one another by press joining at locations 35 of the connecting lug 33. This connection in the four corner regions of the installation frame 5 gives the latter its basic stability. At a bottom end section of the bottom wall region 31 of the side walls 23, 24 of the installation frame 5, an installation shoulder 37 is bent at right angles around the periphery and extends parallel to the supporting shoulder 21 and/or to the glass-ceramic panel 7 (FIGS. 1 and 3). The installation shoulder 37 surrounds a large-surface-area base cutout 39 and, in addition, has component openings 41 distributed essentially around the periphery (FIGS. 1 and 3). In these component openings 41, it is possible to secure components of the cook top 1, for example lighting elements, switches or electronic components, e.g. a residual-heat display unit (not shown). Parallel to the side wall 24 of the installation frame 5, a heat shield 43 is bent at right angles from the installation shoulder 37 in order to provide thermal protection for particularly temperature-sensitive electronic components secured in the component openings 41 beneath the glass-ceramic panel 7 (FIG. 3).

Figure 2:
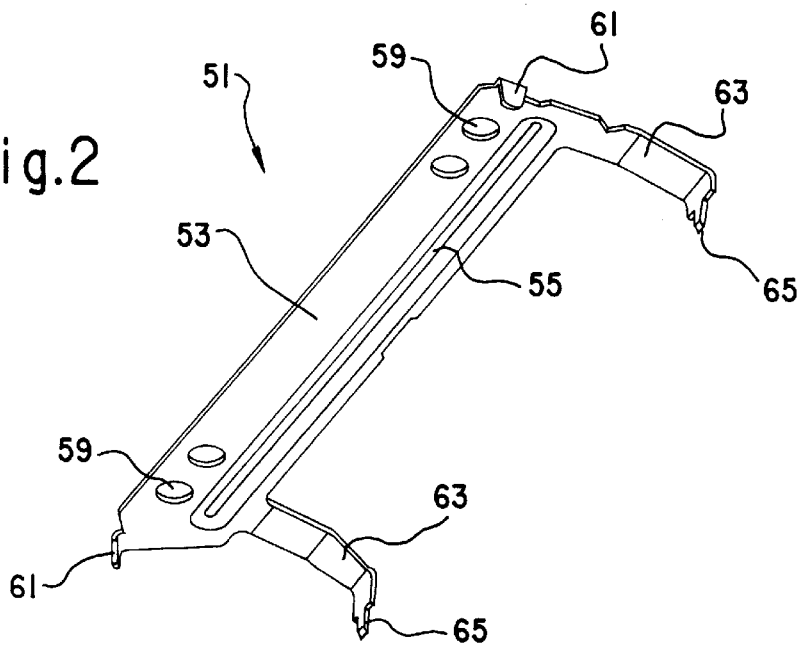
FIG. 2 is a perspective view of a heating-element securing element of the cook top.

The cook top 1 described according to FIGS. 1 and 3 is assembled as now described. First of all the decorative frame 3 is positioned with the top side of its decorative-frame cover panel 11, for example, on an assembly table (installation direction according to FIG. 3 or directional arrow in FIG. 1). Then the first and the second sealing beads 13, 15 are injected onto the underside of the decorative-frame panel 11, the underside being freely accessible from above. Thereafter, the glass-ceramic panel 7 is placed in a precisely positioned manner in the receiving space of the decorative-frame panel 11, the receiving space being bounded by the decorative-frame side wall 9. Furthermore, the adhesive-tape portions 17 are adhesively bonded around the periphery of the underside of the glass-ceramic panel 7, the underside projecting upward in the installation position. It is also the case that the silicone adhesive 19 is applied in the peripheral border region of the glass-ceramic panel 7 and in the border gap between the glass-ceramic panel 7 and the decorative-frame side wall 9 (FIG. 1). Thereafter, the installation frame 5 is placed, by way of its supporting shoulder 21, on the glass-ceramic panel 7 and/or the adhesive-tape portions 17. After this, pressure is exerted on the installation frame 5 uniformly over the surface of the glass-ceramic panel 7. As a result, around the periphery, the elastic adhesive-tape portions 17 are compressed slightly. In the next step, all the lugs 29, which are initially located in the plane of the decorative-frame side wall 9, are simultaneously positioned in the lug openings 27 of the side wall 23, 24 of the installation frame 5. Following this production step, the pressure of the installation frame 5 on the adhesive-tape portions 17 is eliminated. On account of the elastic properties of the adhesive-tape portions 17, the installation frame 5 is pushed away from the glass-ceramic panel 7 and the decorative frame 3 until the corresponding edges of the installation lugs 29 strike against the corresponding opening edges of the lug opening 27. In this position of the installation unit, the adhesive bead 19 sets, as a result of which the geometrical positioning of the frame parts 3, 5 and of the glass-ceramic panel 7 in relation to one another is defined in a permanent manner. In this case, the elasticity and the geometry of the second sealing bead 15 and of the decorative-frame panel 11 are coordinated with one another such that the decorative frame 11 butts, with all-around sealing, in an essentially gap-free manner against the top side of the glass-ceramic panel 7. The corresponding components are then inserted into the component openings 41 and secured therein (not shown). Furthermore heating elements 45 are placed into the base cutout 39 of the installation frame 5, onto the underside of the glass-ceramic panel 7, and are pressed against the latter in a precisely positioned manner by securing elements 51 which will be explained below (FIGS. 2 and 3). Finally, the installation frame 5 is closed off on the base side by a cover (not shown).

For the production of the installation frame 5, basically the following steps are carried out in a suitable order. It should be noted here that the bending steps are carried out first and only then are the installation openings for cook top components produced in accordance with the desired type of cook top that is to be produced. First, the four installation-frame side walls 23, 24 are bent individually at right angles out of a plane of a sheet-metal panel. That surface region of the panel that then remains in the plane of the sheet-metal panel later forms the installation shoulder 37 of the installation frame 5. The supporting shoulders 21 are each bent at right angles from the end sections of the installation-frame side walls 23, 24. In order to complete the single-piece sheet-metal installation frame 5, which is produced by bending, the side walls 23, 24 are fixed to one another in the abutting border regions, in the region of the connecting lugs 33, by press joining or clinching (FIG. 1). In addition, in order to increase the rigidity of the installation frame 5, elongated profile regions are realized in the side walls 23 by bending. Thereafter, in dependence on the respectively desired type of cook top, the large-surface-area base cutout 39 and the component openings 41 are punched in a suitable manner out of the sheet-metal panel. Furthermore, the base panel is provided with thread indentations, in particular in order for it to be possible to close off the cook top 1 on the base side by a non-illustrated cover.

For the adjustment and/or positioning and installation of the heating elements 45 and/or of the heating-element casings 47, known per se, on the underside of the glass-ceramic panel 7, the heating-element casings 47 are placed into the stable structural unit which is formed of the frames 3, 5 and glass-ceramic panel 7 and has been preassembled as described above (FIG. 3). Provided on the base of the heating-element casings 47 are numerous numbered positioning openings 49 suitably spaced apart from one another on a circle in a manner known per se. The precise positioning of the heating-element casing 47 relative to the corresponding decorative printing, on the top side of the glass-ceramic panel 7, in a degree of inaccuracy in the range of less than 1 mm is realized as now described. For each heating-element casing 47, precisely one of the securing elements 51 made of spring-steel material is fastened on the installation shoulder 37. The securing element 51 has a flat and elongated basic body 53. In order to increase its stability, a stamped formation 55 is provided over essentially its entire length. By use of screws 57, which project through corresponding screw-openings 59 of the securing element 51, the securing element 51 is fastened on the installation shoulder 37, in a longitudinal side of the installation frame 5. Provided at the two opposite end sections of the basic body 53 are positioning hooks 61 which are spaced as far apart as possible from one another and are bent at right angles from the basic body. These positioning hooks are inserted in correspondingly configured openings of the installation shoulder 37. In order to increase the positional accuracy, one of the essentially vertically downwardly projecting positioning hooks 61 is disposed at an angle of approximately 45° to the other positioning hook (FIGS. 2 and 3). Furthermore, two arms 63, which are likewise spaced far apart from one another, project from the basic body 53 and project from the plane of the installation shoulder 37 and/or of the basic body 53 into the base cutout 39 of the installation frame 5. The arms 63 terminate in casing hooks 65 which engage in the corresponding positioning openings 49 of the base of the heating-element casing 47. As the spacing between the casing hooks 65 increases, the positional accuracy in relation to the heating-element casing 47 in the cook top 1 also increases. This spacing is typically approximately ½ of the diameter of the heating-element casing 47. In this case, the securing element 51 serves, on the one hand, for positioning and/or adjusting the heating-element casing 47 relative to the frame 3, 5 and/or the glass-ceramic panel 7 and, on the other hand, for pressing the heating-element casing 47 onto the underside of the glass-ceramic panel 7. This holding-down function can be enhanced by additional auxiliary devices provided in the cover of the installation frame 5, for example springs or stamped formations (not shown).

We claim:

1. A cook top, comprising:

a cook top panel; and a metallic, single-piece installation frame receiving and securing said cook top panel, said metallic, single-piece installation frame having side walls extending substantially perpendicularly to said cook top panel and a base side, said base side having an installation shoulder extending parallel to said cook top panel, at a spacing from said cook top panel, said installation shoulder having component openings formed therein for securing other components, said base side having a large-surface-area base opening formed therein and delimited by said installation shoulder, said side walls being individual side-walls sections separate from one another and each being bent individually at right angles from said installation shoulder around a periphery.

2. The cook top according to claim 1, including a decorative frame disposed on said metallic, single-piece installation frame, said side walls of said metallic, single-piece installation frame having installation openings formed therein for securing said decorative frame on said metallic, single-piece installation frame.

3. The cook top according to claim 1, wherein said metallic, single-piece installation frame has a corner region and in each case two of said side walls of said metallic, single-piece installation frame are connected to one another by press joining in said corner region.

4. The cook top according to claim 1, wherein said metallic, single-piece installation frame has in each case shoulder-shaped supporting sections bent at right angles from said side walls of said metallic, single-piece installation frame, said cook top panel being disposed on said shouldered-shaped supporting sections.

5. The cook top according to claim 1, wherein said side walls have elongated profile regions for stabilizing said installation frame.

6. The cook top according to claim 2, including an adhesive connection for connecting said cook top panel to at least one of said metallic, single-piece installation frame and said decorative frame.

7. The cook top according to claim 1, wherein said cook top panel is formed of a glass ceramic.

8. A process for producing a rectangular, single-piece, metallic installation frame for a cook top, which comprises:

providing a base panel;

forming side walls each bent at right angles, as individual surfaces, out of the base panel and a remaining panel of the base panel defining an installation shoulder;

fixing adjacent side walls to one another in respectively adjacent border regions;

punching out component openings in the installation shoulder, the component openings being provided for securing further components to the installation shoulder; and punching out a large-surface-area cutout in the installation shoulder.

9. The process according to claim 8, which comprises forming from the side walls in each case shoulder-shaped supporting sections being sections bent at right angles from and extending from the side walls, the shoulder-shaped support sections being formed to receive a cook top panel.

* * * * *